US007961203B2

(12) United States Patent
Bexal et al.

(10) Patent No.: US 7,961,203 B2
(45) Date of Patent: Jun. 14, 2011

(54) METHOD FOR CONTROLLING A DISPLAY SCREEN, IN PARTICULAR A PLASMA DISPLAY SCREEN, AND DEVICE FOR SAME

(75) Inventors: Jean-Raphaël Bexal, Grenoble (FR); Jérôme Bourgoin, Fontaine (FR)

(73) Assignee: STMicroelectronics S.A., Montrouge (FR)

( * ) Notice: Subject to any disclaimer, the term of this patent is extended or adjusted under 35 U.S.C. 154(b) by 955 days.

(21) Appl. No.: 11/788,031

(22) Filed: Apr. 18, 2007

(65) Prior Publication Data

US 2007/0252781 A1 Nov. 1, 2007

(30) Foreign Application Priority Data

Apr. 19, 2006 (FR) ..... 06 03445

(51) Int. Cl.
*G09G 5/10* (2006.01)
*G09G 3/28* (2006.01)

(52) U.S. Cl. ..... 345/690; 345/60; 345/63; 345/204

(58) Field of Classification Search ..... 345/55, 345/60, 63, 204, 690
See application file for complete search history.

(56) References Cited

U.S. PATENT DOCUMENTS 4,316,123 A * 2/1982 Kleen et al. ..... 315/169.4

FOREIGN PATENT DOCUMENTS

EP 837443 A1 * 4/1998
WO WO-0215163 2/2002

OTHER PUBLICATIONS

Preliminary French Search Report, FR 06 03446, dated Jan. 2, 2007.

* cited by examiner

*Primary Examiner* — My-Chau T Tran
(74) *Attorney, Agent, or Firm* — Gardere Wynne & Sewell LLP; Andre M. Szuwalski

(57) ABSTRACT

A display screen is controlled through successive scans of the display screen. Each scan of the display screen includes a successive selection of rows of the display screen. For each row selected, and in accordance with a normal selection, a first column selection mode is implemented wherein a first selection signal is generated for the column, that first selection signal going from a first state towards a second state with an intermediate plateau level therebetween. In an alternative operation, a second column selection mode is provided which replaces the first column selection mode, the second column selection mode including the generation of a second selection signal going from the first state to the second state without any intermediate plateau level. At least at the start of each scan, the first selection mode is replaced by the second selection mode and this second selection mode is maintained for a given column, at the latest, for as long as no deselection of the column has been effected.

16 Claims, 4 Drawing Sheets

METHOD FOR CONTROLLING A DISPLAY SCREEN, IN PARTICULAR A PLASMA DISPLAY SCREEN, AND DEVICE FOR SAME

PRIORITY CLAIM

The present application is a translation of and claims priority from French Application for Patent No. 06 03445 of the same title filed Apr. 19, 2006, the disclosure of which is hereby incorporated by reference.

BACKGROUND OF THE INVENTION

1. Technical Field of the Invention

The present invention relates to plasma display screens, and more particularly to the control of the cells of such a display screen.

2. Description of Related Art

A plasma display screen is a screen of the matrix display type, formed from cells disposed at the interconnections of rows and columns. A cell comprises a cavity filled with a rare gas, and at least two control electrodes. In order to create a light point on the display screen using a given cell, the cell is selected by applying a potential difference between its control electrodes, then ionization of the gas in the cell is triggered generally by means of a third control electrode. This ionization is accompanied by an emission of ultraviolet rays. The creation of the light point is obtained by excitation of a red, green or blue light-emitting material by the emitted rays.

Conventionally, the control of a plasma display screen essentially comprises two phases, namely an address phase in which the cells (pixels) which will need to be lit and those that will need to be extinguished are determined, together with a display phase proper in which the cells having been selected in the address phase are effectively lit.

The address phase comprises a sequential selection of the rows of the matrix, generally a successive selection of the even rows followed by a successive selection of the odd rows. By way of example, a standby potential, for example 150 volts, is applied to the unselected rows, whereas an activation potential, for example 0 volts, is applied to a selected row. In order to select pixels chosen from the selected row, the pixels that will need to be lit in the display phase, a relatively high potential is for example applied to the corresponding columns of the matrix, for example 70 volts, via a power stage comprising MOS power transistors. Columns corresponding to the other pixels of the selected row, which will not need to be lit, have a potential of 0 volts applied to them. Thus, the cells of the activated row, which will need to be lit, see a column-row potential equal to around 70 volts whereas the other cells of this row see a column-row potential equal to 0 volts.

However, by applying different potentials to the rows of the matrix, it may also be envisaged in the address phase that a high potential be applied to a column in order to select a pixel which will need to be extinguished, and that a low potential be applied to a column in order to select a pixel which will need to be lit.

Reference is made to international patent application WO 02/15163, the disclosure of which is hereby incorporated by reference, which presents an example of the general operation of such a plasma display screen.

Conventionally, the selection and the deselection of the columns of the display screen are carried out by means of a selection and deselection signal according to a mode called "charge sharing effect" (CSE) mode.

During a selection when the column selection signal is emitted, according to the CSE mode, a part of the charges required originate from a capacitor incorporated within the display screen control circuitry.

In other words, when a column is selected, a part of the charges needed to generate the selection signal are transferred from the aforementioned capacitor towards the column to be selected. Once these charges have been transferred, the selection signal has reached a first intermediate plateau level value The output of the column driver circuit, coupled to the column in question, is then switched onto the power supply terminal of the circuit, in such a manner as to complete the amplitude of the selection signal up to its maximum value, generally the value of the power supply voltage.

Conversely, when the column is deselected, the output of the column driver circuit is firstly coupled to the charge capacitor so as to charge it up by returning a part of the charges to it. The deselection signal therefore goes from its maximum value to the intermediate plateau level value, then the column driver circuit output coupled to the column in question is switched towards the ground of the circuit, such that the deselection signal reaches its minimum value.

The CSE mode allows the power consumption of the circuit to be reduced since a part of the charge originates from a capacitor. The power gain with respect to a circuit operating without this mode can reach as much as 50%.

However, when the CSE mode is selected, certain pixels of the display screen having been addressed in order to be lit remain dark at the time of the ignition phase, in particular at the start of each scan of the display screen.

There is accordingly a need to provide a solution to this problem. There is a need to eliminate the appearance of dark pixels on the screen, in particular at the start of the display screen scan, while at the same time conserving the CSE mode allowing consumed power to be saved.

SUMMARY OF THE INVENTION

To address the foregoing and other needs, a method for controlling a matrix display screen comprises successive scans of the display screen, each scan of the display screen comprising a successive selection of rows of the display screen and, for each row selected, a first column selection mode in which each column to be selected is selected with a first selection signal going from a first state towards a second state with an intermediate plateau level.

According to one feature, a second column selection mode is also provided in which each column to be selected is selected with a second selection signal going from the first state to the second state without intermediate plateau level. At least at the start of each scan, the first selection mode is replaced by the second selection mode and this second selection mode is maintained, for a given column, for a period lasting at the latest until deselection of the column has been effected.

In other words, the first selection mode (which is the CSE mode in the case of the selection of a column) for a column to be selected is eliminated, as long as this column has not been deselected.

It is observed that the dark pixels appeared systematically at the start of the scan of the display screen, when a pixel belonging to a previously deselected column, was selected. In this case, the selection signal is subject to the CSE mode, with the generation of the signal in two stages. On the other hand, when a selected column was maintained in this same state between two successive even or odd rows (case where the CSE mode has no effect), the problem does not occur.

Consequently, it is deduced from this that the problem was associated with the CSE mode and more particularly with the transfer of the charge from the storage means towards the outputs of the column driver unit. Indeed, by observing the selection signals for various rows of the display screen, it is observed that the portion of the signal due to the transfer of charge from the storage means towards the output did not go from its minimum value to the value of the intermediate plateau level.

The selection signal was then only triggered at the moment when the output of the column driver unit was switched to the power supply terminal of the circuit. This delay then led to interference on the data transmitted at the same moment to the column driver circuit for the addressing of the next row.

The absence of charge transfer between the storage means and the output of the column driver unit indicates the insufficiency of charge within the storage means at the moment when the selection signal is generated.

This situation is justified in that, before each start of a scan of the display screen, the validation signal of the address phase has returned to the low state forcing the coupling of the outputs of the column driver unit towards ground.

When the validation signal goes back to the low state at the moment when the last row of the display screen is addressed, the last transfer of energy, where required, from the column capacitors towards the storage capacitor is not carried out owing to the coupling of the outputs of the column driver unit towards ground.

Consequently, at the beginning of a fresh scan of the display screen, the storage capacitor is not sufficiently charged to ensure a transfer of the charge towards the outputs of the driver unit of the columns to be selected.

By allowing, at least at the start of each scan, the columns to be selected without involving the storage means during the selection of the columns, the fact that the storage means might be discharged at this time is avoided.

According to one embodiment, the scanning of the display screen comprises an address phase associated with a validation signal. During the address phase, for each row selected, the columns to be selected and the columns to be deselected are determined, the address phase being effected when the validation signal is in an active state. For each column to be selected, the first selection mode can be replaced by the second selection mode, also when the validation signal of the address phase switches to the active state.

According to one embodiment, the display screen comprises n columns coupled to a charge storage means. The second selection mode can preferably be maintained until the moment when it is detected that the quantity of charge stored by the storage means has reached the given threshold.

In other words, instead of waiting for the column in question to be selected, the quantity of charge in a storage means is determined, and if this quantity is sufficient, the first selection mode is re-established.

The storage means comprises for example a storage capacitor, across whose terminals the voltage is measured. The quantity of stored charge is considered to have reached the threshold when the measured voltage has reached a chosen value.

According to another embodiment, the quantity of stored charge is considered to have reached the threshold when n column deselections have been counted.

According to another aspect, a device for controlling a matrix display screen comprises scanning means comprising a row driver unit capable of successively selecting each row, and a column driver unit capable, for each row selected, of selecting a set of deselected columns, the column driver unit being capable, for each row selected, of selecting, according to a first selection mode, each column to be selected with a first selection signal going from a first state towards a second state with an intermediate plateau level.

According to this aspect, the column driver unit is also capable of operating according to a second column selection mode in which the column driver unit is capable of selecting each column to be selected with a second selection signal going from the first state to the second state without intermediate plateau level. The column driver unit is capable, at least at the start of each scan, of replacing the first selection mode by the second selection mode, and of maintaining the second selection mode for a given column, at the latest, for as long as the column has not been deselected.

According to one embodiment, the scanning means comprise addressing means associated with a validation signal, capable of determining, for each row selected, the columns to be selected and the columns to be deselected, when the validation signal is in an active state. The column driver unit is also capable of replacing, for each column to be selected, the first selection mode by the second selection mode, when the validation signal of the addressing means switches to the active state.

According to one embodiment, the display screen comprises n columns coupled to a charge storage means. The device can also comprise means for detecting the quantity of charge stored by the storage means, the column driver unit being capable of maintaining the second selection mode until the moment when the detection means detect that the quantity of charge stored by the storage means has reached the given threshold.

The storage means for example comprises a storage capacitor. The detection means then comprise measurement means capable of measuring the voltage across the terminals of the storage capacitor, the given threshold corresponding to a chosen value of the measured voltage across the terminals of the storage capacitor.

The device can also comprise storage means capable, during the first selection mode, of storing a variable taking a first value as soon as the driver unit replaces the first selection mode by the second selection mode, and otherwise a second value.

The device can also comprise, for each column, reset means receiving the variable at the input and delivering a secondary variable, taking the second value as soon as the column in question is deselected.

Thus, by re-establishing the coupling between the storage means and the output of the column driver unit, the deselection of the columns may then be effected in the conventional manner, which allows the storage means to be recharged and the first selection mode to be re-established for the next selection of the column in question.

According to another aspect, a display screen system, in particular a matrix plasma display screen, incorporates a control device such as that described hereinabove.

In an embodiment, a method for controlling a driving of columns of a display, comprises: testing whether a storage capacitor for multiple columns of the display stores a voltage in excess of a certain threshold voltage value; implementing a first selection mode when voltage stored by the storage capacitor is tested to exceed the certain threshold voltage value, the first selection mode comprising generating a column voltage signal going from a first low voltage state towards a second high voltage state with an intermediate voltage plateau level reached therebetween; and implementing a second selection mode when voltage stored by the storage capacitor is tested to be less than the certain threshold voltage value, the second selection mode comprising generating the column voltage signal going from the first low voltage state towards the second high voltage state without any intermediate voltage plateau level therebetween.

In an embodiment, a circuit for controlling a driving of columns of a display, comprises: a measurement circuit that tests whether a storage capacitor for multiple columns of the display stores a voltage in excess of a certain threshold voltage value; a mode control circuit that implements a first and a second selection mode: the mode control circuit implementing the first selection mode when voltage stored by the storage capacitor is tested to exceed the certain threshold voltage value, and generating a column voltage signal going from a first low voltage state towards a second high voltage state with an intermediate voltage plateau level reached therebetween; and the mode control circuit implementing the second selection mode when voltage stored by the storage capacitor is tested to be less than the certain threshold voltage value and generating the column voltage signal going from the first low voltage state towards the second high voltage state without any intermediate voltage plateau level therebetween.

BRIEF DESCRIPTION OF THE DRAWINGS

Other advantages and features will become apparent upon examining the detailed description of non-limiting embodiments and the appended drawings in which.

DETAILED DESCRIPTION OF THE PREFERRED EMBODIMENTS

Figure 1:
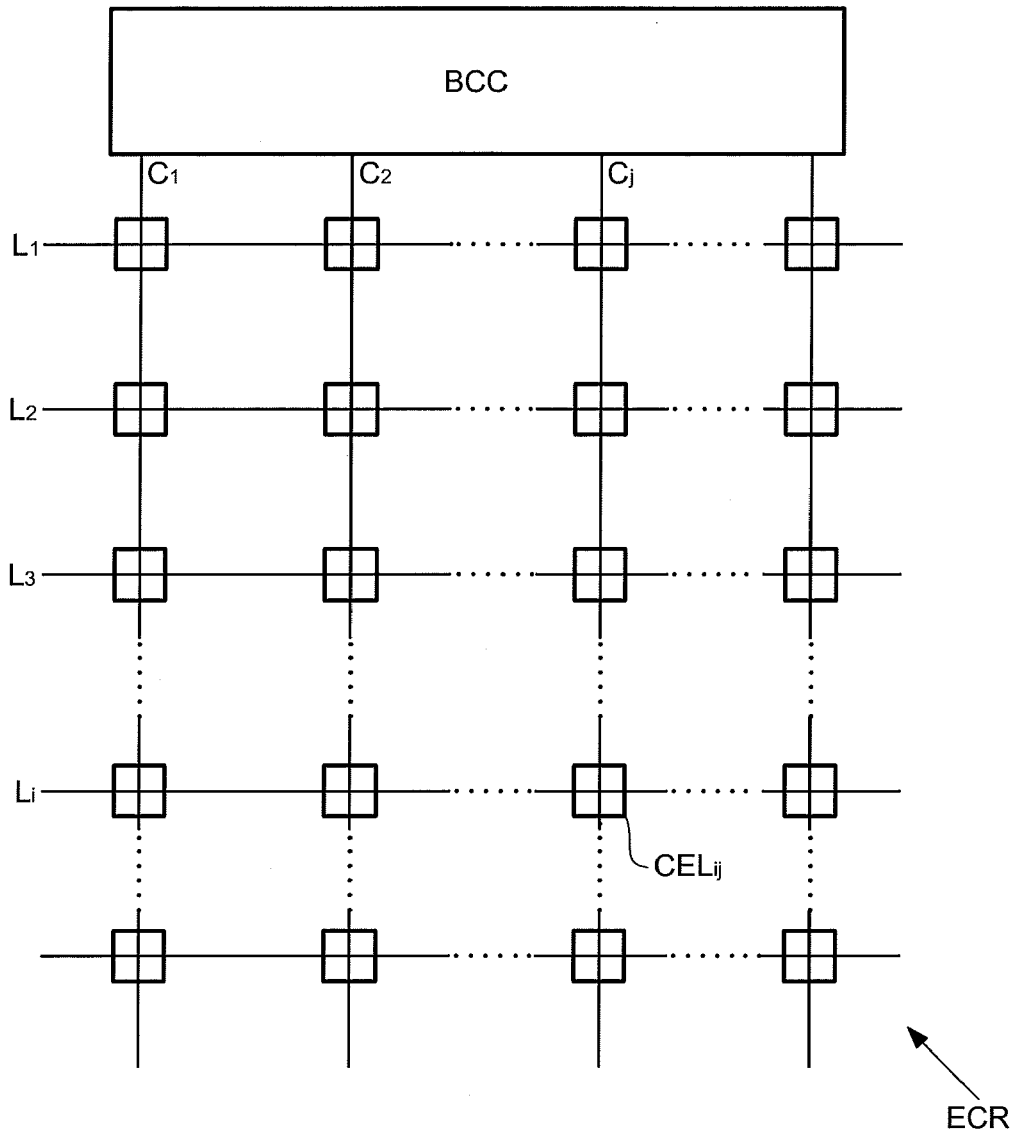
FIG. 1 is a very schematic illustration of a matrix display screen according to one embodiment.

FIG. 1 shows very schematically one structure of a matrix plasma display screen ECR formed from a cell CELij (corresponding to pixels of the image). Each cell CELij has two control electrodes respectively connected to a row Li and to a column Cj, j varying from 0 to n (n being the number of columns in the display screen).

Each cell has an equivalent capacitance of the order of several tens of pF.

The control device of this display screen comprises a row driver circuit capable of sequentially selecting the rows of the matrix (not shown), and a column driver circuit BCC capable of selecting and, where required, deselecting several previously selected columns.

These circuits are generally integrated onto a semiconductor chip.

Conventionally, when a column has been selected, its potential is set at a high value Vpp, typically around 70 volts (in order to light or extinguish a pixel according to the embodiment chosen for the display screen).

Figure 2:
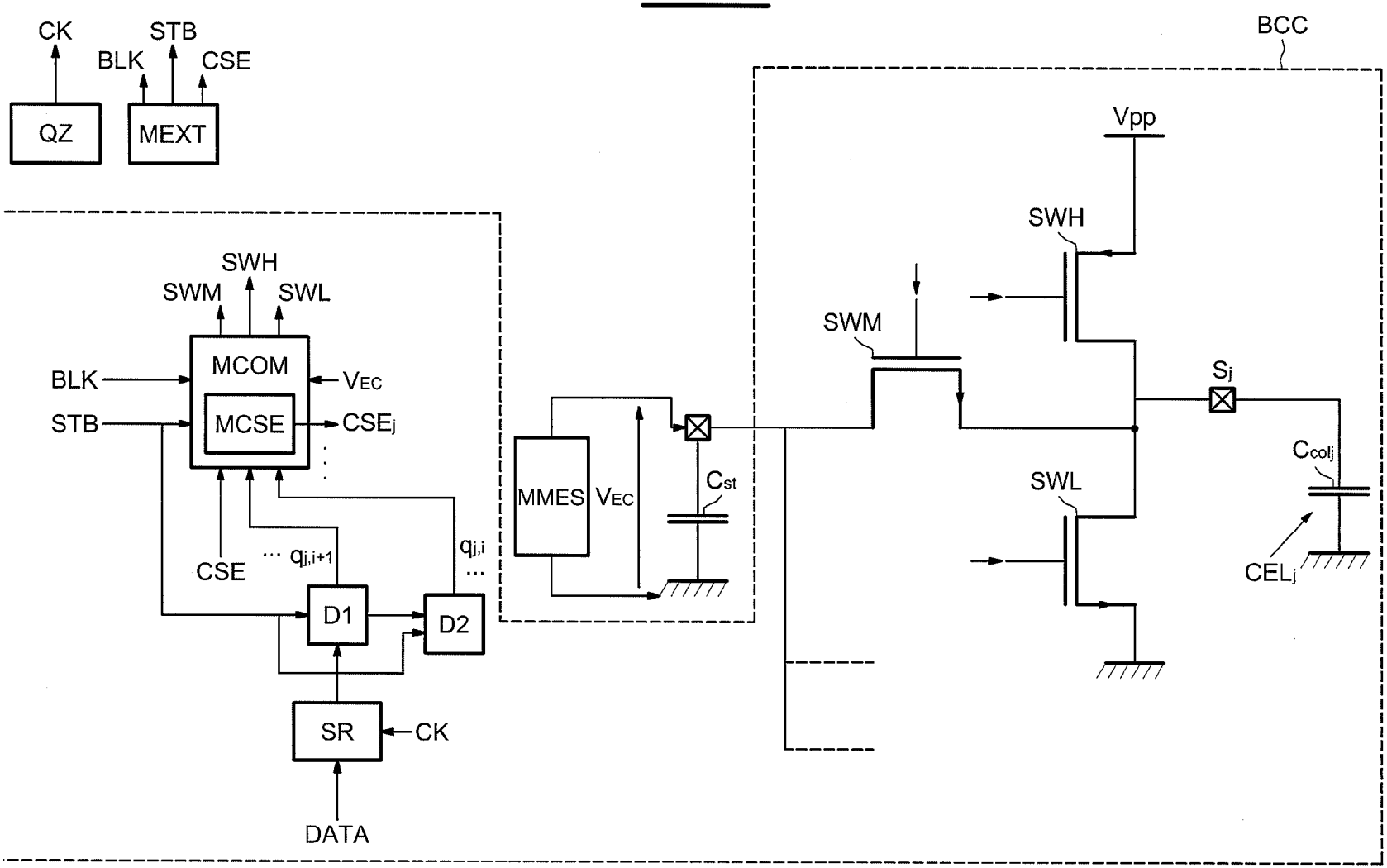
FIG. 2 describes one embodiment of a device.

More precisely, as shown in FIG. 2, the column driver unit BCC conventionally comprises three transistors SWH, SWL and SWM, respectively, controlled by control means MCOM.

The transistor SWH can, for example, be a transistor of the n-MOS type.

The transistor SWH can connect the output Sj to the power supply voltage Vpp. This output Sj is the output of the column driver unit BCC which is connected to the column Cj comprising the cells CELj (each cell CELj comprising a capacitor Ccolj).

Conversely, the transistor SWL allows the output Sj to be connected to the ground of the circuit GND. The transistor SWL can be formed, for example, by means of a p-MOS transistor.

The control means can take the form of an integrated circuit within the column driver unit BCC, or be upstream of the latter.

As a variant, the control means MCOM can be formed by means of a software tool.

The display screen also comprises a storage capacitor Cst (preferably external to the column driver unit BCC), coupled between ground and all the display screen columns.

As an example, for the column Cj, the capacitor Cst is connected to the output Sj via the transistor SWM.

The storage capacitor Cst can be a specific capacitor added to the circuit, its capacitive value being preferably equal to the sum of the capacitive values of the capacitors Ccolj. But the storage capacitor may also be formed by the whole of the capacitances already present in each component of the circuit.

The transistor SWM can for example be a transistor of the p-MOS type, associated with a diode DSWM (not explicitly shown in FIG. 2) connected between its source and its drain.

The voltage $V_{EC}$ is measured across the terminals of the storage capacitor Cst using measurement means MMES, for example a comparator. The value of this voltage $V_{EC}$ varies between zero and a value in the range between zero and Vpp, preferably Vpp/2.

As a variant, a counter for the number of column deselections could be provided, the tallying of n deselections guaranteeing that the capacitor Cst is charged up, in other words $V_{EC}$>VPP/2.

The control means MCOM receive at their input the value of the voltage $V_{EC}$ measured across the terminals of the storage capacitor Cst, and of signals STB, CSE and BLK, respectively, generated by external means MEXT.

The signal STB (for "Strobe") allows the control signal for the transistor SWM to be generated, as will be seen hereinbelow.

The signal CSE indicates that the selection and the deselection of the columns are made according to the CSE mode.

The signal BLK corresponds to the validation signal of the address phase.

Finally, the control means MCOM are coupled to a shift-register SR that receives at its input the data DATA to be delivered to each column Cj during the address phase. The register SR is timed by a clock signal CK, generated for example by a quartz clock QZ.

The output of the register SR is connected to a first flip-flop D1, for example a flip-flop D controlled by the signal STB.

Upon a given clock pulse, the register SR delivers the data qj,i, for the column Cj and the row Li, to the flip-flop D1.

Upon the following clock pulse, the register SR delivers the data for the column Cj and the row Li+1 to the flip-flop D1, which then sends its data qj,i towards a second flip-flop D2 (for example a flip-flop D).

These data transfers are performed for all of the columns Cj, j varying between 0 and n.

Consequently, the flip-flops D1 and D2 respectively deliver the data qj,i and qj,i+1 to the control means MCOM, upon each edge of the signal STB.

The means MCOM subsequently address each row Li+1, upon each falling edge, for example, of the signal STB, with the data qj,i+1.

Furthermore, the means MCOM determine the changes of state of a column Cj by comparing the data qj,i and qj,i+1, as will be seen hereinbelow.

The control means MCOM incorporate means MCSE for controlling the CSE mode that are capable, starting from the signal STB, from the CSE mode signal, from the signal BLK and from the data qj,i and qj,i+1, of generating an internal CSE mode signal for each column Cj, this internal signal (explained in more detail hereinbelow) being referenced CSEj.

Figure 3:
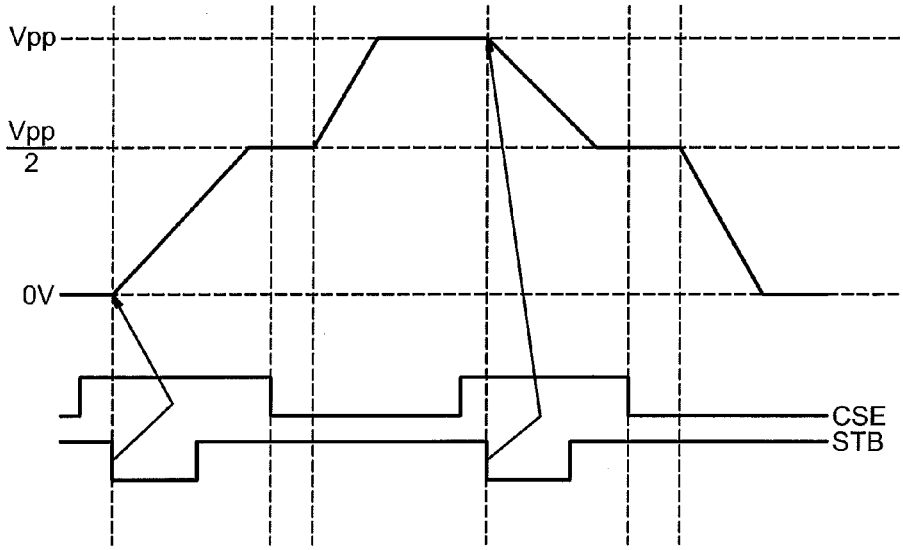
FIG. 3 illustrates the variation of the selection signal according to the selection mode used.

Reference is now made to FIG. 3 which illustrates the variations of the selection signal for a column Cj, in the address phase and during the CSE mode, according to a first conventional selection mode.

When the CSE mode is selected (CSE=1), a falling edge of the signal STB triggers the discharge of the storage capacitor Cst towards the output Sj of the unit BCC (the transistor SWM is therefore "on", and the transistors SWL and SWH "off").

When the signal CSE returns to zero, the signal at the output Sj goes from the value Vpp/2 to Vpp (the transistor SWH is therefore "on", and the transistors SWL and SWM "off").

When the column Cj is deselected, operation returns to CSE mode (CSE=1) in order to generate a deselection signal going from Vpp to 0, with an intermediate plateau level.

A new falling edge of the. signal STB causes the capacitor Ccolj to discharge towards the storage capacitor Cst for as long as the value of the deselection signal at the output of Sj remains in the range between Vpp and Vpp/2 (the transistor SWM is "on", and the transistors SWL and SWH "off").

Then, when the signal CSE returns to zero, the control means cause the output Sj to switch towards ground GND (the transistor SWL is therefore "on", and the transistors SWH and SWM "off").

However, a second selection mode may replace the aforementioned first mode, when the storage capacitor is discharged, as explained hereinabove.

Figure 4:
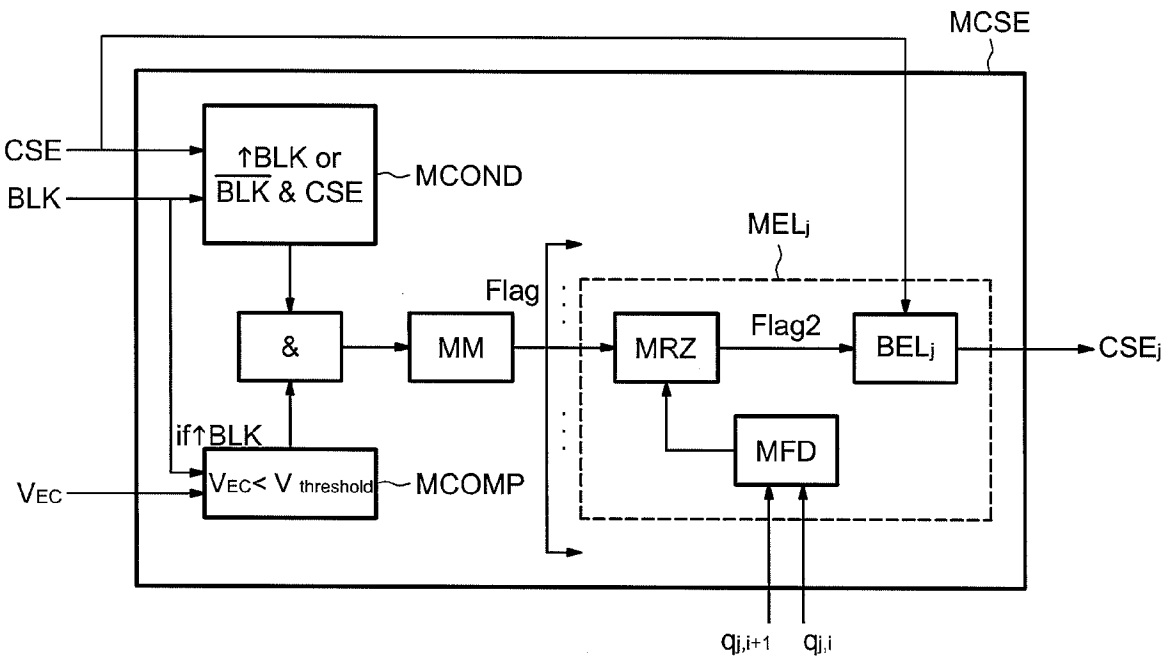
FIG. 4 illustrates more precisely one embodiment of a means for generating a selection signal.

In order to achieve this, the means MCSE (shown in FIG. 4) comprise means MCOND capable of detecting whether the conditions allowing switching to the second selection mode are met.

These means MCOND receive the signal CSE and the validation signal for the address phase BLK at their input.

If the means MCOND have recorded a rising edge of the signal BLK (↑BLK), indicating the validation of the address phase, the means MCOND request the switching to the second selection mode.

Since an edge of the signal BLK occurs at least at the start of each scan of the display screen, the replacement of the first selection mode by the second selection mode is made at each start of the scan of the screen.

As a variant, if the scanning comprises two sub-scans, for example a sub-scan of the even rows followed by a sub-scan of the odd rows, an edge of the signal BLK occurs at the start of each sub-scan.

As a variant, in the course of the address phase (BLK=1), the voltage VEC can also be measured and be compared with a threshold voltage Vthreshold, for example equal to Vpp/2.

In this manner, if the charge on the storage capacitor Cst is high enough to allow the operation of the column driver BCC according to the first selection mode, then the latter is re-established.

For this purpose, the means MSCE comprise storage means MM capable of storing a variable "Flag" taking the value "0" if the first selection mode must be applied, and "1" if the first selection mode is replaced by the second selection mode.

This variable "Flag" is delivered to generation means MELj for the signal CSEj.

Each generation means MELj comprises means MRZ for resetting the variable "Flag" and delivers a secondary variable Flag2 generated from the variable "Flag".

The reset means MRZ are controlled by means for detecting a falling edge MFD.

The means MFD receive the data qj,i+1 and qj,i at their input, in such a manner as to detect the occurrence of a falling edge for a column Cj between two successive row selections, Li and Li+1.

The variable Flag2 initially takes the value of the variable "Flag". Consequently, if the second selection mode is applied, Flag2 is equal to 1.

Then, if a falling edge is detected, the means MFD deliver a signal to the reset means MRZ so as to set the variable "Flag" to zero for the column Cj.

Thus, during the deselection, the signal CSj allows the charge to be transferred from the column capacitor Ccolj towards the storage capacitor Cst so as to recharge the latter.

Subsequently, during the next selection of the column Cj, the first selection mode will be applied.

Figure 5:
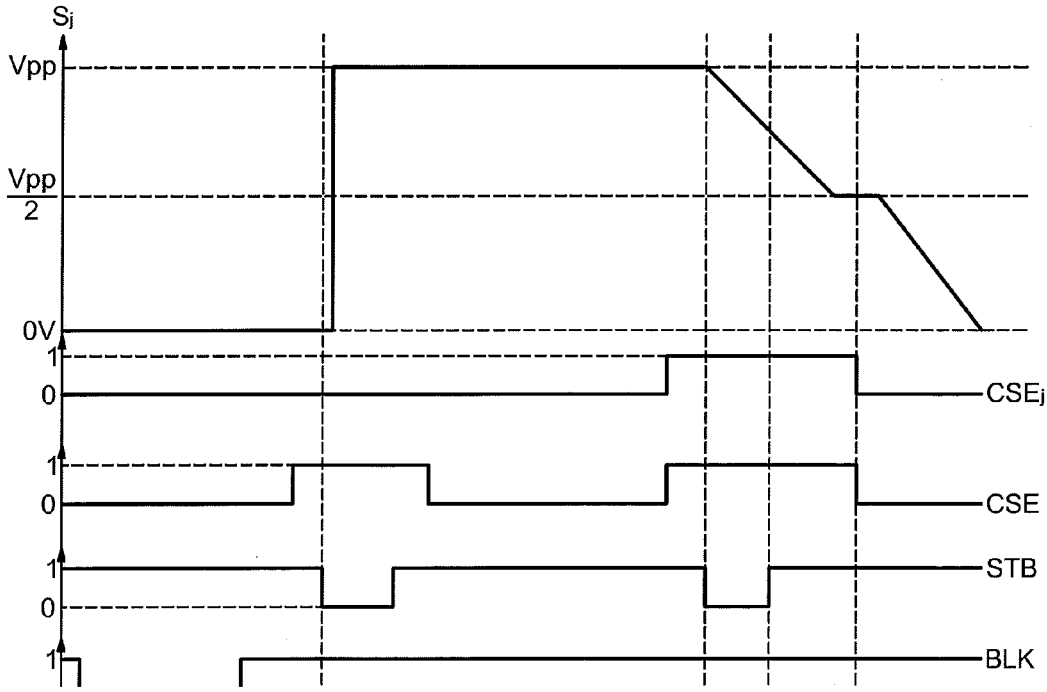
FIG. 5 illustrates one exemplary variant of the selection signal according to the second selection mode.

Lastly, the generation means MELj comprise a generation unit BELj receiving the variable "Flag" and the signal CSE at its input so as to generate the signal CSEj as described in FIG. 5.

Furthermore, the means MCOND can also store a synchronization condition ($\overline{BLK}$ & CSE) in such a manner as not to trigger the rising edge of the selection signal as long as the dark screen signal has not taken the value "1".

FIG. 5 illustrates the variation of the selection signal at the output Sj, in the case where the second selection mode replaces the first selection mode.

At time t0, the signal BLK goes from "0" to "1". The driver unit BCC replaces the first selection mode by the second (it is assumed that $V_{CE}$<Vthreshold).

In this case, although the signal CSE is at 1, the signal CSj remains at zero. Consequently, at the falling edge of the signal STB, the selection signal goes directly from zero volts to Vpp, without intermediate plateau level.

Then, during the deselection of the column in question, when the signal CSE returns to the value "1", the signal CSj also returns to the value "1", so as to re-adopt the conventional mode of operation.

Thus, at the falling edge of the signal STB, the selection signal goes from Vpp to Vpp/2(implying the charging of the storage capacitor Cst) then, after an additional plateau level, from the value Vpp/2 to zero volts.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A method for controlling scanning of a display screen using a successive selection of rows of the display screen, comprising for each row selected, operating a driver circuit using one of:

a first column selection mode in which each column to be selected is selected with a first selection signal generated by the driver circuit, the first selection signal going from a first state towards a second state with an intermediate plateau level reached therebetween, and a second column selection mode in which each column to be selected is selected with a second selection signal generated by the driver circuit, the second selection signal going from the first state to the second state without the intermediate plateau level being reached therebetween;

wherein, at least at the start of each scan, the first column selection mode is replaced by the second column selection mode and this second column selection mode is maintained, for a given column, for a period lasting until at the latest when a deselection of the column has been effected.

2. The method according to claim 1, in which the scanning the display screen comprises an address phase associated with a validation signal, during which, for each row selected, the columns to be selected and the columns to be deselected are determined, the address phase being effected when the validation signal is in an active state, and in which, for each column to be selected, the first selection mode is replaced by the second selection mode, also when the validation signal of the address phase switches to the active state.

3. The method according to claim 1, in which the display screen comprises n columns coupled to a charge storage means, and in which the second selection mode is maintained until the moment when it is detected that the quantity of charge stored by the storage means has reached a given threshold.

4. The method according to claim 3, in which the storage means comprises a storage capacitor, across whose terminals the voltage is measured, and the quantity of stored charge is considered to have reached the threshold when the measured voltage has reached a chosen value.

5. The method according to claim 3, in which the quantity of stored charge is considered to have reached the threshold when n column deselections have been counted.

6. A method for controlling a driving of columns of a display, comprising:

comparing a voltage stored by a storage capacitor for multiple columns of the display stores to a certain threshold voltage value;

implementing a first selection mode when comparing indicates that the voltage stored by the storage capacitor exceeds the certain threshold voltage value, the first selection mode comprising controlling a driver circuit to generate a column voltage signal going from a first low voltage state towards a second high voltage state with an intermediate voltage plateau level being reached therebetween; and implementing a second selection mode when comparing indicates that the voltage stored by the storage capacitor is less than the certain threshold voltage value, the second selection mode comprising controlling the driver circuit to generate the column voltage signal going from the first low voltage state towards the second high voltage state without any intermediate voltage plateau level being reached therebetween.

7. The method of claim 6 where each of the first and second selection mode further subsequently generates the column voltage signal going from the second high voltage state to the first low voltage state with the intermediate voltage plateau level being reached therebetween.

8. The method of claim 6 wherein implementing of the second selection mode is maintained, for a given column, until such time as the given column is deselected.

9. The method according to claim 1, where each of the first and second column selection modes further subsequently generates the selection signal going from the second high voltage state to the first low voltage state with the intermediate voltage plateau level being reached therebetween.

10. A method for controlling a successive scanning of a display screen having a plurality of rows, comprising:

operating a driver circuit to implement one of:

a first column selection mode comprising, for each column to be selected, the generation by the driver circuit of a first selection signal transitioning from a first state towards a second state with an intermediate plateau level therebetween, and a second column selection mode comprising, for each column to be selected, the generation by the driver circuit of a second selection signal transitioning from the first state to the second state without the intermediate plateau level therebetween; and when the first column selection mode is implemented, replacing the first column selection mode with the second column selection mode; and maintaining the second column selection mode, for a given column, until a deselection of the column in the scanning has been effected.

11. The method of claim 10, further comprising:

testing whether a storage capacitor for multiple columns of the display stores a voltage in excess of a certain threshold voltage value; and wherein implementing comprises:

implementing the first column selection mode when voltage stored by the storage capacitor is tested to exceed the certain threshold voltage value; and implementing the second column selection mode when voltage stored by the storage capacitor is tested to be less than the certain threshold voltage value.

12. The method of claim 10 where each of the first and second column selection modes further comprises subsequently generating the selection signal transitioning from the second high voltage state to the first low voltage state with the intermediate voltage plateau level therebetween.

13. The method of claim 10, further comprising determining, for each selected row, columns in that row to be selected and columns in that row to be deselected; and for each column that is selected, replacing the first column selection mode with the second column selection mode.

14. The method of claim 10, in which the display screen comprises n columns coupled to a charge storage device, and further comprising maintaining the second column selection mode until a quantity of charge on the charge storage device reaches a threshold.

15. The method of claim 14, wherein the charge storage device comprises a capacitor, further comprising measuring a voltage across the capacitor, the second column selection mode being maintained until the measured voltage reaches a threshold voltage value.

16. The method of claim 14, wherein the quantity of charge reaches the threshold when n column deselections have been counted.

* * * * *